US007402370B2

(12) United States Patent
Kmiecik-Lawrynowicz et al.

(10) Patent No.: US 7,402,370 B2
(45) Date of Patent: Jul. 22, 2008

(54) SINGLE COMPONENT DEVELOPER OF EMULSION AGGREGATION TONER

(75) Inventors: Grazyna E Kmiecik-Lawrynowicz, Fairport, NY (US); Maura A Sweeney, Irondequoit, NY (US); Daniel W Asarese, Honeoye Falls, NY (US); Eunhee Lee, Honeoye Falls, NY (US); Robert D Bayley, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 423 days.

(21) Appl. No.: 11/213,754

(22) Filed: Aug. 30, 2005

(65) Prior Publication Data

US 2007/0048643 A1 Mar. 1, 2007

(51) Int. Cl.
*G03G 9/093* (2006.01)

(52) U.S. Cl. ..... 430/108.6; 430/108.7; 430/110.4; 430/111.4

(58) Field of Classification Search ..... 430/108.6, 430/108.7, 110.4, 111.4
See application file for complete search history.

(56) References Cited

U.S. PATENT DOCUMENTS

| | | | |
|---|---|---|---|
| 3,674,736 | A | 7/1972 | Lerman et al. |
| 4,338,390 | A | 7/1982 | Lu |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,462,828 | A | 10/1995 | Moffat et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,744,520 | A | 4/1998 | Kmiecik-Lawrynowicz et al. |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,853,944 | A | 12/1998 | Foucher et al. |
| 5,869,215 | A | 2/1999 | Ong et al. |
| 6,120,967 | A | 9/2000 | Hopper et al. |
| 6,576,389 | B2 | 6/2003 | Vanbesien et al. |
| 2004/0202950 | A1 * | 10/2004 | Ahuja et al. ..... 430/137.14 |
| 2004/0229144 | A1 * | 11/2004 | Silence et al. ..... 430/108.4 |
| 2005/0136351 | A1 * | 6/2005 | Vandewinckel et al. .. 430/107.1 |

* cited by examiner

*Primary Examiner*—John L Goodrow
(74) *Attorney, Agent, or Firm*—Oliff & Berridge, PLC

(57) ABSTRACT

A toner for developing electrostatic images in a single component development (SCD) system free of carrier and including emulsion aggregation toner particles of a styrene acrylate polymer binder, at least one release agent and at least one colorant, wherein the toner particles have a volume average particle size of from about 5 μm to about 10 μm, an average circularity of about 0.95 to about 0.99, a volume and number geometric standard deviation ($GSD_{v\ and\ n}$) of from about 1.10 to about 1.30, and an onset glass transition temperature of from about 45° C. to about 65° C., is ideally suited for forming an image using a single component image forming device.

19 Claims, No Drawings

SINGLE COMPONENT DEVELOPER OF EMULSION AGGREGATION TONER

BACKGROUND

Described herein are toners, and single component developers containing the toners, for use in forming and developing images of good quality and gloss, and in particular to a toner having a novel combination of properties ideally suited for use in image forming devices utilizing single component development.

Emulsion aggregation toners are excellent toners to use in forming print and/or xerographic images in that the toners can be made to have uniform sizes and in that the toners are environmentally friendly. U.S. patents describing emulsion aggregation toners include, for example, U.S. Pat. Nos. 5,370,963, 5,418,108, 5,290,654, 5,278,020, 5,308,734, 5,344,738, 5,403,693, 5,364,729, 5,346,797, 5,348,832, 5,405,728, 5,366,841, 5,496,676, 5,527,658, 5,585,215, 5,650,255, 5,650,256, 5,501,935, 5,744,520, 5,763,133, 5,766,818, 5,747,215, 5,827,633, 5,853,944, 5,804,349, 5,840,462, and 5,869,215, each incorporated herein by reference in its entirety.

One main type of emulsion aggregation toners includes emulsion aggregation toners that are acrylate based, e.g., styrene acrylate toner particles. See, for example, U.S. Pat. No. 6,120,967, incorporated herein by reference in its entirety, as one example.

Emulsion aggregation techniques typically involve the formation of an emulsion latex of the resin particles, which particles have a small size of from, for example, about 5 to about 500 nanometers in diameter, by heating the resin, optionally with solvent if needed, in water, or by making a latex in water using an emulsion polymerization. A colorant dispersion, for example of a pigment dispersed in water, optionally also with additional resin, is separately formed. The colorant dispersion is added to the emulsion latex mixture, and an aggregating agent or complexing agent is then added to form aggregated toner particles. The aggregated toner particles are optionally heated to enable coalescence/fusing, thereby achieving aggregated, fused toner particles.

U.S. Pat. No. 5,462,828 describes a toner composition that includes a styrene/n-butyl acrylate copolymer resin having a number average molecular weight of less than about 5,000, a weight average molecular weight of from about 10,000 to about 40,000 and a molecular weight distribution of greater than 6 that provides excellent gloss and high fix properties at a low fusing temperature.

What is still desired is a styrene acrylate emulsion aggregation toner that can achieve excellent print quality, particularly for use in single component developer image forming devices.

SUMMARY

In embodiments, described is a single component developer free of carrier and including toner comprising emulsion aggregation toner particles comprising a styrene acrylate polymer binder, at least one wax and at least one colorant, wherein the toner particles have a volume average particle size of from about 5 μm to about 10 μm, an average circularity of about 0.95 to about 0.99, a volume and number geometric standard deviation ($GSD_{v\ and\ n}$) of from about 1.10 to about 1.30, and an onset glass transition temperature of from about 45° C. to about 65° C.

The single component developer may be comprised of toner particles that, exclusive of external additives, are free of silica. Further, the toner particles may include a shell layer upon core particles.

In further embodiments, described is a set of four self-developing color toners comprising a cyan toner, a magenta toner, a yellow toner and a black toner, wherein each of the toners is a single component toner free of carrier and each of the cyan toner, magenta toner, yellow toner and black toner are comprised of emulsion aggregation toner particles comprising a styrene acrylate polymer binder, at least one release agent and at least one colorant. Each of the color toner particles have a volume average particle size of from about 5 μm to about 10 μm, preferably from about 6 μm to about 8 μm, an average circularity of about 0.95 to about 0.99, a volume and number geometric standard deviation ($GSD_{v\ and\ n}$) of from about 1.10 to about 1.30, more preferred from about 1.15 to about 1.25, and an onset glass transition temperature of from about 45° C. to about 65° C.

In still further embodiments, described is a method of forming an image with a single component developer, wherein the single component developer comprises toner particles free of carrier, comprising applying the toner particles having a triboelectric charge to an oppositely charged latent image on an imaging member to develop the image, and transferring the developed image to an image receiving substrate, and wherein the toner particles contain emulsion aggregation toner particles comprising a styrene acrylate polymer binder, at least one release agent and at least one colorant, wherein the toner particles have a volume average particle size of from about 5 μm to about 10 μm, an average circularity of about 0.95 to about 0.99, a volume and number geometric standard deviation ($GSD_{v\ and\ n}$) of from about 1.10 to about 1.30, and an onset glass transition temperature of from about 45° C. to about 65° C. The image may be formed with a Single Component Development (SCD) Printer.

DETAILED DESCRIPTION OF EMBODIMENTS

For single component developers, i.e., developers that contain no charge carriers as in two component developers, it is important for the toner particles to exhibit high transfer efficiency (including excellent flow properties and low cohesivity) and an ability to take on an appropriate triboelectric charge. The toners described herein in embodiments have appropriate compositions and physical properties to be ideally suited for use in single component developer machines. These compositions and properties will be detailed below.

The toner particles described herein are comprised of at least styrene acrylate polymer binder and a colorant. A release agent such as wax is also preferably included in the toner particles. The rheology can be adjusted by changing the resin molecular weight, coagulating agent level, release agent composition and/or machine fuser configuration.

Illustrative examples of specific styrene acrylate polymer resins for the binder, mention may be made of, for example, poly(styrene-alkyl acrylate), poly(styrene-alkyl methacrylate), poly(styrene-alkyl acrylate-acrylic acid), poly(styrene-alkyl methacrylate-acrylic acid), poly(styrene-alkyl acrylate-acrylonitrile-acrylic acid), poly(styrene-propyl acrylate), poly(styrene-butyl acrylate), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and other similar styrene acrylate polymers.

Preferably, the binder is comprised of a styrene-alkyl acrylate. More preferably, the styrene-alkyl acrylate is a styrene-butyl acrylate copolymer resin, e.g., most preferably a styrene-butyl acrylate-β-carboxyethyl acrylate polymer resin.

In embodiments, it has been found that the styrene acrylate binder resin as prepared into a toner particle preferably should have a glass transition temperature of from about 45° C. to about 65° C., more preferably from about 55° C. to about 60° C.

The monomers used in making the polymer binder are not limited, and the monomers utilized may include any one or more of, for example, styrene, acrylates such as methacrylates, butylacrylates, β-carboxyethyl acrylate (β-CEA), ethylhexyl acrylate, octylacrylate, etc., butadiene, isoprene, acrylic acid, methacrylic acid, itaconic acid, acrylonitrile, etc., and the like. Known chain transfer agents can be utilized to control the molecular weight properties of the polymer. Examples of chain transfer agents include dodecanethiol, dodecylmercaptan, octanethiol, carbon tetrabromide, carbon tetrachloride, and the like in various suitable amounts, for example of about 0.1 to about 10 percent by weight of monomer, and preferably of about 0.2 to about 5 percent by weight of monomer. Also, crosslinking agents such as decanedioldiacrylate or divinylbenzene may be included in the monomer system in order to obtain higher molecular weight polymers, for example in an effective amount of about 0.01 percent by weight to about 25 percent by weight, preferably of about 0.5 to about 10 percent by weight.

In a preferred embodiment, the monomer components, with any of the aforementioned optional additives, are preferably formed into a latex emulsion and then polymerized to form small sized polymer particles, for example on the order of about 5 nm to about 500 nm, more preferably about 180 nm to about 300 nm. In addition, the latex emulsion preferably has a weight average molecular weight (Mw) of from about 20 to about 100 kpse, more preferably from about 30 to about 60 kpse, a number average molecular weight (Mn) of from about 5 to about 30 kpse, more preferably from about 8 to about 20 kpse, and a Tg of from about 45° C. to about 65° C., more preferably from about 55° C. to about 60° C.

The monomers and any other emulsion polymerization components may be polymerized into a latex emulsion with or without the use of suitable surfactants, as necessary. Of course, any other suitable method for forming the latex polymer particles from the monomers may be used without restriction.

Various known colorants, such as pigments, dyes, or mixtures thereof, present in the toner in an effective amount of, for example, from about 1 to about 20 percent by weight of toner, and preferably in an amount of from about 3 to about 12 percent by weight, that can be selected include black, cyan, violet, magenta, orange, yellow, red, green, brown, blue or mixtures thereof.

Examples of a black pigment include carbon black, copper oxide, manganese dioxide, aniline black, activated carbon, non-magnetic ferrite and magnetite and the like, and wherein the magnetites, especially when present as the only colorant component, can be selected in an amount of up to about 70 weight percent of the toner.

Specific examples of blue pigment include Prussian Blue, cobalt blue, Alkali Blue Lake, Victoria Blue Lake, Fast Sky Blue, Indanethrene Blue BC, Aniline Blue, Ultramarine Blue, Calco Oil Blue, Methylene Blue Chloride, Phthalocyanine Blue, Phthalocyanine Green and Malachite Green Oxalate or mixtures thereof. Specific illustrative examples of cyans that may be used as pigments include Pigment Blue 15:1, Pigment Blue 15:2, Pigment Blue 15:3 and Pigment Blue 15:4, copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like.

Examples of a green pigment include Pigment Green 36, Pigment Green 7, chromium oxide, chromium green, Pigment Green, Malachite Green Lake and Final Yellow Green G.

Examples of a red pigment include red iron oxide, cadmium red, red lead oxide, mercury sulfide, Watchyoung Red, Permanent Red 4R, Lithol Red, Naphthol Red, Brilliant Carmine 3B, Brilliant Carmine 6B, Du Pont Oil Red, Pyrazolone Red, Rhodamine B Lake, Lake Red C, Rose Bengal, Eoxine Red and Alizarin Lake. Specific examples of magentas that may be selected include, for example, Pigment Red 49:1, Pigment Red 81, Pigment Red 122, Pigment Red 185, Pigment Red 238, Pigment Red 57:1, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like.

Examples of a violet pigment include manganese violet, Fast Violet B and Methyl Violet Lake, Pigment Violet 19, Pigment Violet 23, Pigment Violet 27 and mixtures thereof.

Specific examples of an orange pigment include Pigment Orange 34, Pigment Orange 5, Pigment Orange 13, Pigment Orange 16, and the like. Other orange pigments include red chrome yellow, molybdenum orange, Permanent Orange GTR, Pyrazolone Orange, Vulkan Orange, Benzidine Orange G, Indanethrene Brilliant Orange RK and Indanethrene Brilliant Orange GK.

Specific examples of yellow pigments are Pigment Yellow 17, Pigment Yellow 74, Pigment Yellow 83, Pigment Yellow 93, and the like. Other illustrative examples of yellow pigment include chrome yellow, zinc yellow, yellow iron oxide, cadmium yellow, chrome yellow, Hansa Yellow, Hansa Yellow 10G, Benzidine Yellow G, Benzidine Yellow GR, Suren Yellow, Quinoline Yellow, Permanent Yellow NCG. diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL.

Examples of a white pigment include Pigment White 6, zinc white, titanium oxide, antimony white and zinc sulfide.

Colorants for use herein can include one or more pigments, one or more dyes, mixtures of pigment and dyes, mixtures of pigments, mixtures of dyes, and the like. The colorants are used solely or as a mixture.

Examples of a dye include various kinds of dyes, such as basic, acidic, dispersion and direct dyes, e.g., nigrosine, Methylene Blue, Rose Bengal, Quinoline Yellow and Ultramarine Blue.

A dispersion of colorant particles can be prepared by using, for example, a rotation shearing homogenizer, a media dispersing apparatus, such as a ball mill, a sand mill and an attritor, and a high pressure counter collision dispersing apparatus. The colorant can be dispersed in an aqueous system with a homogenizer by using a surfactant having polarity.

The colorant may be selected from the standpoint of hue angle, chroma saturation, brightness, weather resistance, OHP transparency and dispersibility in the toner. The colorant can be added in an amount of from 2 to 15% by weight based on the weight of the total solid content of the toner. In the case where a magnetic material is used as a black colorant, it can be added in an amount of from 10 to 70% by weight, which is different from the other colorants. The mixing amount of the colorant is such an amount that is necessary for assuring coloration property upon fixing. In the case where the colorant particles in the toner have a median diameter of from 100 to 330 nm, the OHP transparency and the coloration property can be assured. The median diameter of the colorant particles can be measured, for example, by a laser diffraction particle size measuring apparatus (MicroTrac UPA 150, produced by MicroTrac Inc.).

In the case where the toner is used as a magnetic toner, magnetic powder may be contained therein. Specifically, a substance that can be magnetized in a magnetic field is used, examples of which include ferromagnetic powder, such as iron, cobalt and nickel, and compounds, such as ferrite and magnetite.

In the case where the toner is obtained in an aqueous system, it is necessary to attend to the aqueous phase migration property of the magnetic material, and it is preferred that the surface of the magnetic material is modified in advance, for example, subjected to a hydrophobic treatment.

The colorant, preferably carbon black, cyan, magenta and/or yellow colorant, is incorporated in an amount sufficient to impart the desired color to the toner. In general, pigment or dye is employed in an amount ranging from about 2% to about 35% by weight of the toner particles on a solids basis, preferably from about 4% to about 10% by weight of the toner particles on a solids basis. Of course, as the colorants for each color toner (e.g., black, cyan, magenta and yellow in a traditional four color toner set) are different, the amount of colorant present in each type of color toner typically is different, although still generally within the above general ranges.

In addition to the latex polymer binder and the colorant, the toners also preferably contain a release agent, preferably a wax dispersion. The release agent is added to the toner formulation in order to aid toner offset resistance, e.g., toner release from the fuser roll, particularly in low oil or oil-less fuser designs. Specific examples of the release agent include a low molecular weight polyolefin, such as polyethylene, polypropylene and polybutene, a silicone exhibiting a softening point upon heating, an aliphatic amide, such as oleic acid amide, erucic acid amide, recinoleic acid amide and stearic acid amide, vegetable wax, such as carnauba wax, rice wax, candelilla wax, wood wax and jojoba oil, animal wax, such as bees wax, mineral or petroleum wax, such as montan wax, ozokerite, ceresin, paraffin wax, microcrystalline wax and Fischer-Tropsch wax, and modified products thereof.

The release agent may be dispersed in water along with an ionic surfactant or a polymer electrolyte, such as a polymer acid and a polymer base, and it is heated to a temperature higher than the melting point thereof and is simultaneously dispersed with a homogenizer or a pressure discharge disperser (Gaulin Homogenizer) capable of applying a large shearing force, so as to form a dispersion of particles having a median diameter of 1 μm or less.

The release agent is preferably added in an amount of from about 5% to about 25% by weight, more preferably about 8% to about 12% by weight, based on the total weight of the solid content constituting the toner, in order to assure releasing property of a fixed image in an oil less fixing system.

The particle diameter of the resulting release agent particle dispersion can be measured, for example, by a laser diffraction particle size measuring apparatus (MicroTrac UPA 150 manufactured by MicroTrac Inc.). The preferred particle size of the release agent is less than 1.0 micron. Upon using the release agent, it is preferred that the resin fine particles, the colorant fine particles and the release agent particles are aggregated, and then the resin fine particle dispersion is further added to attach the resin fine particles on the surface of the aggregated particles from the standpoint of assurance of charging property and durability.

In addition, the toners herein may also optionally contain a coagulant. Suitable optional coagulants include any coagulant known or used in the art, including the well known coagulants polyaluminum chloride (PAC) and/or polyaluminum sulfosilicate (PASS). A preferred coagulant is polyaluminum chloride. The coagulant is present in the toner particles, exclusive of external additives and on a dry weight basis, in amounts of from 0 to about 5% by weight of the toner particles, preferably from about greater than 0 to about 2% by weight of the toner particles.

The toner may also include additional known positive or negative charge additives in effective suitable amounts of, for example, from about 0.1 to about 5 weight percent of the toner, such as quaternary ammonium compounds inclusive of alkyl pyridinium halides, bisulfates, organic sulfate and sulfonate compositions such as disclosed in U.S. Pat. No. 4,338,390, cetyl pyridinium tetrafluoroborates, distearyl dimethyl ammonium methyl sulfate, aluminum salts or complexes, and the like.

In a preferred embodiment, the toner particles have a core-shell structure. In this embodiment, the core is comprised of the toner particle materials discussed above, including at least the binder and the colorant, and preferably also the wax. Once the core particle is formed and aggregated to a desired size, as will be discussed further below, a thin outer shell is then formed upon the core particle. The shell is preferably comprised of only binder material (i.e., free of colorant, release agent, etc.), although other components may be included therein if desired.

The shell is preferably comprised of a latex resin that can be the same composition as the latex of the core particle or can have two entirely different compositions or properties. For example, the latex resin of the shell and the latex resin of the core may be the same or may be composed of a similar polymer with different chemical and physical characteristics.

Although the shell latex may be comprised of any of the polymers identified above, it is preferably a styrene acrylate polymer, most preferably a styrene-butyl acrylate polymer, including a styrene-butyl acrylate-β carboxyethyl acrylate. The shell latex may be added to the toner aggregates in an amount of about 1% to about 50% by weight of the total binder materials, and preferably in an amount of about 5% to about 30% by weight of the total binder materials. Preferably, the shell or coating on the toner aggregates has a thickness wherein the thickness of the shell is about 0.2 to about 1.5 μm, preferably about 0.5 to about 1.0 μm.

In embodiments, the shell may have either the same, a higher or a lower glass transition temperature (Tg) than the styrene acrylate binder of the toner core particle, depending upon the fusing system being used. A higher Tg may be desired to limit penetration of the external additives and/or wax into the shell, while a lower Tg shell is desired where greater penetration of the external additives and/or wax is desired. A higher Tg shell may also lend better shelf and storage stability to the toner.

The total amount of binder, including in the core, and also in the shell if present, preferably comprises from about 50 to about 95% by weight of the toner particles (i.e., toner particles exclusive of external additives) on a solids basis, preferably from about 60 to about 80% by weight of the toner.

Also, in preparing the toner by the emulsion aggregation procedure, one or more surfactants may be used in the process. Suitable surfactants may include anionic, cationic and nonionic surfactants.

Anionic surfactants include sodium dodecylsulfate (SDS), sodium dodecyl benzene sulfonate, sodium dodecylnaphthalene sulfate, dialkyl benzenealkyl, sulfates and sulfonates, and abitic acid. An example of a preferred anionic surfactant consists primarily of branched sodium dodecyl benzene sulfonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecyl benzyl triethyl ammonium chloride, benzalkonium chlorides, and the like. An example of a preferred cationic surfactant is benzyl dimethyl alkonium chloride.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy) ethanol. An example of a preferred nonionic surfactant is alkyl phenol ethoxylate.

Any suitable emulsion aggregation (EA) procedure may be used in forming the emulsion aggregation toner particles without restriction. These procedures typically include the basic process steps of at least aggregating a latex emulsion containing binder, one or more colorants, optionally one or more surfactants, optionally a wax emulsion, optionally a coagulant and one or more additional optional additives to form aggregates, optionally forming a shell on the aggregated core particles as discussed above, subsequently optionally coalescing or fusing the aggregates, and then recovering, optionally washing and optionally drying the obtained emulsion aggregation toner particles.

An example emulsion aggregation coalescing process preferably includes forming a mixture of latex binder, colorant dispersion, optional wax emulsion, optional coagulant and deionized water in a vessel. The mixture is then sheared using a homogenizer until homogenized and then transferred to a reactor where the homogenized mixture is heated to a temperature of, for example, at least about 50° C., preferably about 60° C. to about 70° C. and held at such temperature for a period of time to permit aggregation of toner particles to a desired size. In this regard, aggregation refers to the melding together of the latex, pigment, wax and other particles to form larger size agglomerates. Once a desired core particle size is reached, additional latex binder may then be added to form a shell upon the aggregated core particles. Once the desired size of aggregated toner particles is achieved, aggregation is then halted, for example by adjusting the pH of the mixture in order to inhibit further toner aggregation. The toner particles are further heated to a temperature of, for example, at least about 80° C., preferably from about 90° C. to about 105° C., and the pH adjusted in order to enable the particles to coalesce and spherodize (become more spherical and smooth). The mixture is then cooled to a desired temperature, at which point the aggregated and coalesced toner particles are recovered and optionally washed and dried.

The toner particles are preferably blended with external additives following formation. Any suitable surface additives may be used. Preferred external additives include one or more of $SiO_2$, metal oxides such as, for example, $TiO_2$ and aluminum oxide. In general, silica is applied to the toner surface for toner flow, tribo enhancement, improved development and transfer stability and higher toner blocking temperature. $TiO_2$ is applied for improved relative humidity (RH) stability, tribo control and improved development and transfer stability. The external surface additives can be used with or without a coating.

In a most preferred embodiment, the toner particles include an external additive package comprised of either or both a first silica and titania. The first silica preferably has a size of about 5 to about 15 nm and is preferably treated/coated with HMDS (hexamethyldisilazane) and/or a PDMS (polydimethylsiloxanes). The first silica is preferably present in an amount of from about 0.1% to about 5.0%, more preferably about 0.1% to about 3.0%, by weight of the toner particle. The inorganic additive particles of this size range preferably exhibit a BET (Brunauer, Emmett and Teller) surface area of from about 100 to about 300 $m^2/g$, more preferably from about 125 to about 250 $m^2/g$, although the values may be outside of this range as needed. The hydrophobic titania (titanium oxide) preferably has a size about 5 nm to about 130 nm, and is preferably present in an amount of from about 0.05% to about 1.0%, more preferably from about 0.1% to about 0.5%, by weight of the toner particle. The titania particles preferably exhibit a BET surface area of from about 20 to about 120 $m^2/g$, more preferably from about 30 to about 80 $m^2/g$, although the values may be outside of this range as needed. The additive package may further include a second silica preferably having a size larger than the first silica and having a size of about 20 nm to about 150 nm, and that is treated and/or coated with HMDS and/or PDMS. The second silica is preferably present in an amount of from about 0.1% to about 5.0%, more preferably from about 0.1% to about 3.0%, by weight of the toner particle. The larger inorganic additive particles preferably exhibit a BET surface area of from about 20 to about 120 $m^2/g$, more preferably from about 30 to about 90 $m^2/g$, although the values may be outside of this range as needed. The larger size silica acts as a spacer material. The larger size silica may be omitted, and no spacer material used, or an alternative spacer material used in its place, without restriction.

In embodiments, the toner particles are made to have an average particle size of from about 5 μm to about 10 μm, more preferably from about 6 μm to about 8 μm, an average circularity of about 0.95 to about 0.99, and a volume and number geometric standard deviation ($GSD_{v\ and\ n}$) of from about 1.10 to about 1.30, more preferably 1.15 to 1.25. The average particle size refers to a volume average size that may be determined using any suitable device, for example a conventional Coulter counter. The circularity may be determined using any suitable method, for example the known Malvern Sysmex Flow Particle Integration Analysis method. The circularity is a measure of the particles closeness to perfectly spherical. A circularity of 1.0 identifies a particle having the shape of a perfect circular sphere. The GSD refers to the upper geometric standard deviation (GSD) by volume (coarse level) for (D84/D50) and the geometric standard deviation (GSD) by number (fines level) for (D50/D16). The particle diameters at which a cumulative percentage of 50% of the total toner particles are attained are defined as volume D50, and the particle diameters at which a cumulative percentage of 84% are attained are defined as volume D84. These aforementioned volume average particle size distribution indexes GSDv can be expressed by using D50 and D84 in cumulative distribution, wherein the volume average particle size distribution index GSDv is expressed as (volume D84/volume D50). These aforementioned number average particle size distribution indexes GSDn can be expressed by using D50 and D16 in cumulative distribution, wherein the number average particle size distribution index GSDn is expressed as (number D50/number D16). The closer to 1.0 that the GSD value is, the less size dispersion there is among the particles. The aforementioned GSD value for the toner particles indicates that the toner particles are made to have a narrow particle size distribution. The toner particles also preferably have an onset glass transition temperature (Tg) of from about 40° C. to about 65° C., preferably from about 55° C. to about 60° C. as measured by DSC.

For some specific formulations, for example for reduced speed SCD applications, i.e., a device printing from 12 to 16 ppm (pages per minute) black, 4 ppm color in regular mode, 8 to 10 ppm black, 2 ppm color in best mode, and may be as high as 20 ppm, the toner preferably has an average particle size of from about 5 to about 10 μm, more preferably from about 6 μm to about 8 μm, a circularity of about 0.95 to about 0.99, and a GSD of about 1.10 to about 1.30, more preferably of about 1.15 to about 1.25. The triboelectric property of this toner, as blended with external additives, is preferably from about 10.0 to about 48.0 μC/g.

For certain other specific formulations, for example for higher speed SCD applications, i.e., a device printing 17 ppm black and color, with an optional upper limit of 30 ppm, the toner preferably has an average particle size of from about 5 μm to about 10 μm, more preferably from about 6 μm to 8 μm, a circularity of about 0.95 to about 0.99, and a GSD of about 1.10 to about 1.30, more preferably of about 1.15 to about 1.25. The triboelectric property of this toner, as blended with an external additive package, is preferably about 10.0 to about 40.0 μC/g.

In an embodiment, the toners comprise a set of four color toners comprising a cyan toner, a magenta toner, a yellow toner and a black toner, wherein each of the toners is preferably a single component toner free of carrier, and each of the toners are comprised of emulsion aggregation toner particles comprising a styrene acrylate polymer binder, at least one release agent and at least one colorant. The differently colored particles preferably have a volume average particle size of from about 5 μm to about 10 μm, more preferably from about 6 μm to 8 μm, an average circularity of about 0.95 to about 0.99, volume and number geometric standard deviation ($GSD_{v\ and\ n}$) of from about 1.10 to about 1.30, more preferably from about 1.15 to about 1.25, and an onset glass transition temperature of from about 45° C. to about 65° C. Each of the differently colored toner particles may have an average particle size of from about 5 μm to about 10 μm, more preferably from about 6 μm to about 8 μm, most preferably from 6.5 μm to about 7.5 μm, and an onset glass transition temperature of from about 45° C. to about 65° C., most preferably from about 55° C. to about 60° C.

The toner particles cohesivity is associated to some degree with the surface morphology of the particles. The rounder/smoother the surface of the particles, the lower the cohesion and the greater the flow. As the surface becomes less round and more rough, the flow worsens and the cohesion increases. The substantially spherical nature of the toner particles herein is thus advantageous. Cohesion is measured with a Hosokawa powder tester using a series of three 8 cm test screens having aperture mesh sizes of 53 μm, 45 μm and 38 μm. The test conditions were set at vibration mode, knob set to 7 for 90 seconds in a thermostat and humidistat chamber HL-40 (or equivalent) made by Nagano Science. The toner cohesion as measured on the Hosokawa Powder Tester manufactured by Hosokawa Micron Corporation is preferably a percent cohesion from about 5% to about 30%, more preferably from about 5% to about 15%, although the values may be outside of this range as needed.

In addition, the toner particles preferably exhibit a BET (Brunauer, Emmett and Teller) surface area of from about 0.5 to about 3.0 $m^2/g$, more preferably from about 0.8 to about 2.0 $m^2/g$, although the values may be outside of this range as needed.

The toner particles also preferably exhibit a toner melt flow index (MFI) of from about 2.0 $m^2/g$ minutes to about 70.0 g/10 min, more preferably about 5.0 to about 30.0 g/10 minutes, at a temperature of 130° C., under an applied load of 5.0 kilograms with an L/D die ratio of 3.8. MFI is an indicator of the toner's rheology, defined as the weight of a toner (in grams) that passes through an orifice of length L and diameter D in a 10 minute period with a specified applied load.

When the toners of embodiments described herein are used in an SCD device to form a black/white or full color toner image, each of the toner colors preferably exhibits a TMAD (toner mass area density) of from about 0.15 to about 0.50, more preferably from about 0.20 to about 0.40, for example as determined by toner measured off the developer roll. This enables significant reduction in the total amount of toner used by the device in developing images.

The toner particles described herein are preferably used as single component developer (SCD) formulations that are free of carrier particles.

The aforementioned toner particles as a single component developer composition in SCD deliver a very high transfer efficiency.

Typically in SCD, the charge on the toner is what controls the development process. The donor roll materials are selected to generate a charge of the right polarity on the toner when the toner is brought in contact with the roll. The toner layer formed on the donor roll by electrostatic forces is passed through a charging zone, specifically in this application a charging roller, before entering the development zone. Light pressure in the development nip produces a toner layer of the desired thickness on the roll as it enters the development zone. This charging typically will be for only a few seconds, minimizing the charge on the toner. An additional bias is then applied to the toner, allowing for further development and movement of the controlled portion of toner to the photoreceptor. If the low charge toner is present in sufficient amounts, background and other defects become apparent on the image. The image is then transferred from the photoreceptor to an image receiving substrate, which transfer may be direct or indirect via an intermediate transfer member, and then the image is fused to the image receiving substrate, for example by application of heat and/or pressure, for example with a heated fuser roll.

In a most preferred embodiment, the toners are ideally suited for use in a device utilizing single component developers. The single component development is sensitive to toner size and shape. Non-optimum particle morphology can lead to accumulation of toner particles on the donor roll, which can lead to the formation of an insulative layer on the donor roll and subsequent reduction in charge development. The toners described herein substantially avoid such problems with their ideal size and shape.

The toner and developer will now be further described via the following examples.

EXAMPLE 1

In this example, a latex is prepared that is suited for use in preparation of toners for a reduced speed SCD device.

The polymer selected for the processes herein can be prepared by emulsion polymerization methods, and the monomers utilized in such processes include, for example, styrene, acrylates, methacrylates, butadiene, isoprene, acrylic acid, methacrylic acid, itaconic acid, beta carboxy ethyl acrylate, acrylonitrile, and the like. Known chain transfer agents, for example dodecanethiol, from, for example, about 0.1 to about 10 percent, or carbon tetrabromide in effective amounts, such as for example from about 0.1 to about 10 percent, can also be utilized to control the molecular weight properties of the polymer when emulsion polymerization is selected. Other processes of obtaining polymer particles of from, for example, about 0.01 micron to about 2 microns can be selected from polymer microsuspension process, such as disclosed in U.S. Pat. No. 3,674,736, the disclosure of which is totally incorporated herein by reference; polymer solution microsuspension process, such as disclosed in U.S. Pat. No. 5,290,654, the disclosure of which is totally incorporated herein by reference, mechanical grinding processes, or other known processes. Also, the reactant initiators, chain transfer agents, and the like as disclosed in many of the Xerox patents mentioned herein, the disclosures of which are totally incorporated herein by reference, can be selected for the processes of the present invention. The emulsion polymerization process may be accomplished by a batch process (a process in which all the components to be employed are present in the polymerization medium at the start of the polymerization) or by continuous emulsification process. The monomer(s) can also be fed neat or as emulsions in water.

In this Example, the monomers are selected from styrene, β carboxyethyl acrylate (βCEA), decanediol diacrylate (A-DOD), dodecanethiol and butyl acrylate, which mixture is subjected to emulsion polymerization to form a latex. The resulting latex contains 41.7% of solids. It has Mw=47.1 kpse, Mn=12.4 kpse (as measured on GPC), Tg=57° C. (DSC) and particle size=286 nm (measured on the MicroTrac UPA 150). This latex was used in the aggregation/coalescence process to prepare cyan, magenta and yellow toner particles in Examples 2-4.

EXAMPLE 2

This example prepares a cyan toner for use in a reduced speed SCD device.

49.4 parts distilled water was charged into 2 L reactor. 24 parts of the Example 1 latex was added followed by 5.6 parts cyan pigment dispersion 15.3 (17% solids). To the latex/pigment mixture, 5.5 parts polyethylene wax dispersion, as well as 3 parts PAC (polyaluminum chloride 10% solution), was added. The mixture was homogenized for 20 min and temperature in the reactor was raised to 64° C. to start aggregation. Aggregation was continued to the point where particles reached 6.7 μm in size. At this point, 12.5 parts of the Example 1 latex was added as a shell, and the particles were grown to 7.5 μm total size. At this point, pH is adjusted to 6.5 by the addition of 4% NaOH. The temperature is raised to 96° C. to perform coalescence. The pH is then adjusted to 4.0. Heating was continued for 4 hrs. Particles were then discharged from the reactor, washed and dried.

The resulting cyan particles were analyzed to have a volume average particle size of 7.43 μm, a circularity of 0.98, a GSD of 1.24, a BET surface area of 1.13 and an onset glass transition temperature of 59° C.

The cyan particles are blended with 1% by weight of small sized silica and 1% by weight of small sized titania. The triboelectric property of the blended single component developer at a toner concentration (pph) of 8.18 is 45.6 μC/g. This is measured by a removal of a measured area of toner from the developer roll by a vacuum suck off, then transferred to a Faraday cage for charge measurement.

EXAMPLE 3

This example prepares a yellow toner for use in a reduced speed SCD device.

49 parts distilled water was charged into 2 L reactor. 24 parts of the Example 1 latex was added, followed by 5.8 parts of yellow pigment dispersion 74 (19% solids). To the latex/pigment mixture, 5.5 parts polyethylene wax dispersion, as well as 3 parts PAC (polyaluminum chloride 10% solution), was added. The mixture was homogenized for 20 min and temperature in the reactor was raised to 64° C. to start aggregation. Aggregation was continued to the point where particles reached 6.7 μm in size. At this point 12.5 parts of the Example 1 latex was added as a shell, and the particles were grown to 7.5 μm. The pH is adjusted to 6.5 by the addition of 4% NaOH, and then the temperature was raised to 96° C. to perform coalescence. At this point, pH is adjusted to 4.0. Heating was continued for 4 hrs. Particles were then discharged from the reactor, washed and dried.

The resulting yellow particles were analyzed to have a volume average particle size of 7.63 μm, a circularity of 0.95, a GSD of 1.20, a BET surface area of 1.58 and an onset glass transition temperature of 58.4° C.

The yellow particles are blended with 1% by weight of small sized silica and 1% by weight of small sized titania. The triboelectric property of the blended single component developer at a toner concentration (pph) of 8.49 is 46.1 μC/g.

EXAMPLE 4

This example prepares a magenta toner for use in a reduced speed SCD device.

49 parts distilled water was charged into 2 L reactor. 24 parts of the Example 1 latex was added followed by 5.9 parts magenta pigment dispersion R122 (18% solids). To the latex/pigment mixture, 5.5 parts polyethylene wax dispersion, as well as 3 parts PAC (polyaluminum chloride 10% solution), was added. The mixture was homogenized for 20 min and temperature in the reactor was raised to 64° C. to start aggregation. Aggregation was continued to the point where particles reached 6.7 μm in size. At this point, 12.5 parts of the Example 1 latex was added as a shell, and the particles were grown to 7.8 μm. The pH is adjusted to 6.5 by the addition of 4% NaOH, and then the temperature was raised to 96° C. to perform coalescence. The pH is adjusted to 4.0. Heating was continued for 9 hrs. Particles were then discharged from the reactor, washed and dried.

The resulting magenta particles were analyzed to have a volume average particle size of 9.72 μm, a circularity of 0.96, a GSD of 1.25, a BET surface area of 2.44 and an onset glass transition temperature of 59.2° C.

The magenta particles are blended with 1% by weight of small sized silica and 1% by weight of small sized titania. The triboelectric property of the blended single component developer at a toner concentration (pph) of 7.98 is 31.4 μC/g.

EXAMPLE 5

In this example, a latex is prepared that is suited for use in the preparation of toners for a high speed SCD device.

In this Example, the monomers are selected from styrene, βCEA, A-DOD, dodecanethiol and butyl acrylate, which mixture is subjected to emulsion polymerization to form a latex. Resulting latexes made by this formulation contain approximately 41.3% solids, Mw of from 34-39 kpse, Mn of from 10-13 kpse (as measured by GPC), Tg of from 57-60° C. (DSC) and particle size of from 180-250 nm (MicroTrac UPA 150). These latexes are used in the aggregation/coalescence process to prepare cyan, magenta, yellow and black toner parent particles (Examples 6-9) for use in a high speed, i.e., 17 ppm and up for both color and black in all modes, SCD device.

EXAMPLE 6

This example prepares a cyan toner for use in a high speed SCD device.

46 parts of distilled water was charged into 2 gallon reactor. 26 parts of the Example 5 latex was added, followed by 4.9 parts of cyan pigment dispersion 15.3 (17% solids). To the latex/pigment mixture, 6.4 parts of polyethylene wax dispersion as well as 0.3 parts of PAC (polyaluminum chloride 10% solution) combined with 3.4 parts 0.02M $HNO_3$ is added. The mixture was homogenized for 20 min and temperature in the reactor was raised to 63° C. to start aggregation. Aggregation was continued to the point where particles reached 6.13 μm in size. At this point, 13 parts of the Example 5 latex was added as a shell, and the particles were grown to 7.55 μm. At this point, pH has been adjusted to 4.2 by the addition of 4% NaOH. The temperature was raised to 96° C. to perform coalescence. The pH is adjusted to 4.0. Heating was continued for 4 hrs. Particles were then discharged from the reactor, washed and dried.

The resulting cyan particles were analyzed to have a volume average particle size of 7.15 μm, a circularity of 0.971, a GSD of 1.21, a BET surface area of 1.03 and an onset glass transition temperature of 56° C.

The cyan particles are blended with 0.8% by weight of octylsilane coated 12 nm silica and 0.5% by weight of 15 nm titania. The triboelectric property of the blended single component developer is 14.33 μC/g as tested in the higher speed SCD device.

EXAMPLE 7

This example prepares a yellow toner for use in a high speed SCD device.

46 parts of distilled water was charged into 2 gallon reactor. 28 parts of the Example 5 latex was added, followed by 4.1 parts of yellow pigment dispersion 74 (19% solids). To the latex/pigment mixture is added 5.6 parts of polyethylene wax dispersion as well as 0.3 parts of PAC (polyaluminum chloride 10% solution) in 3.0 parts 0.02M $HNO_3$. The mixture was homogenized for 20 min and temperature in the reactor was raised to 62° C. to start aggregation. Aggregation was continued to the point where particles reached 5.9 μm in size. At this point, 13 parts of the Example 5 latex was added as a shell, and the particles were grown to 7.2 μm. At this point, pH has been adjusted to 4.5 by the addition of 4% NaOH. The temperature was raised to 96° C. to perform coalescence. At this point, pH is adjusted to 4.0. Heating was continued for 4 hrs. Particles were then discharged from the reactor, washed and dried.

The resulting yellow particles were analyzed to have a volume average particle size of 6.96 μm, a circularity of 0.965, a GSD of 1.20, a BET surface area of 0.99 and an onset glass transition temperature of 58° C.

The yellow particles are blended with 0.8% by weight of octylsilane coated 12 nm silica and 0.5% by weight of 15 nm titania. The triboelectric property of the blended single component developer is 18.3 μC/g as tested in the higher speed SCD device.

EXAMPLE 8

This example prepares a magenta toner for use in a higher speed SCD device.

46 parts of distilled water was charged into 2 liter reactor. 24 parts of the Example 5 latex was added, followed by 7.5 parts of magenta pigment dispersion R122 (18% solids) and 1.3 parts PR185 (17% solids). To the latex/pigment mixture is added 5.36 parts of polyethylene wax dispersion as well as 0.3 parts of PAC (polyaluminum chloride 10% solution) in 2.9 parts 0.02M $HNO_3$. The mixture was homogenized for 20 min and temperature in the reactor was raised to 60° C. to start aggregation. Aggregation was continued to the point where particles reached 5.95 μm in size. At this point, 12.6 parts of the Example 5 latex was added as a shell, and the particles were grown to 7.5 μm. At this point, pH has been adjusted to 5.5 by the addition of 4% NaOH. The temperature was raised to 96° C. to perform coalescence. At this point, pH is adjusted to 4.2. Heating was continued for 4 hrs. Particles were then discharged from the reactor, washed and dried.

The resulting magenta particles were analyzed to have a volume average particle size of 7.46 μm, a circularity of 0.96, a GSD of 1.21, a BET surface area of 2.44 and an onset glass transition temperature of 57.7° C.

The magenta particles are blended with 0.8% by weight of octylsilane coated 12 nm silica and 0.5% by weight of 15 nm titania. The triboelectric property of the blended single component developer is 18.9 μC/g as tested in a higher speed SCD device. The Example 8 toner performs adequately similar to a commercial HP toner.

EXAMPLE 9

This example prepares a black toner for use in a high speed SCD device.

52 parts of distilled water was charged into 2 liter reactor. 24 parts of the Example 5 latex was added, followed by 4.3 parts of REGAL 330 carbon black pigment (17% solids). To the latex/pigment mixture is added 5.2 parts of polyethylene wax dispersion as well as 0.3 parts of PAC (polyaluminum chloride 10% solution) in 2.7 parts 0.02M $HNO_3$. The mixture was homogenized for 20 min and temperature in the reactor was raised to 60° C. to start aggregation. Aggregation was continued to the point where particles reached 5.2 μm in size. At this point, 11.5 parts of the Example 5 latex was added as a shell, and the particles were grown to 7.3 μm. At this point, pH has been adjusted to 6.3 by the addition of 4% NaOH. The temperature was raised to 96° C. to perform coalescence. At this point, pH is adjusted to 4.1. Heating was continued for 4 hrs. Particles were then discharged from the reactor, washed and dried.

The resulting black particles were analyzed to have a volume average particle size of 8.97 μm, a circularity of 0.974, a GSD of 1.20, a BET surface area of 1.60 and an onset glass transition temperature of 58.3° C.

The yellow particles are blended with 0.8% by weight of octylsilane coated 12 nm silica and 0.5% by weight of 15 nm titania. The triboelectric property of the blended single component developer is 13.1 μC/g as tested in the higher speed SCD device.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A toner for developing electrostatic images in a single component development (SCD) system and including toner comprising emulsion aggregation toner particles comprising a styrene acrylate polymer binder, at least one release agent and at least one colorant, wherein the toner particles have a volume average particle size of from about 5 μm to about 10 μm, an average circularity of about 0.95 to about 0.99, a volume and number geometric standard deviation ($GSD_{v\ and\ n}$) of from about 1.10 to about 1.30, and an onset glass transition temperature of from about 45° C. to about 65° C., wherein the toner particles further include a shell layer thereon comprising a styrene acrylate polymer, and wherein the styrene acrylate polymer of the shell layer and the styrene acrylate polymer binder are the same or are composed of a similar polymer with different chemical and physical characteristics.

2. A toner for developing electrostatic images in a single component development (SCD) system according to claim 1, wherein the shell layer has a higher glass transition temperature than the styrene acrylate polymer binder.

3. A toner for developing electrostatic images in a single component development (SCD) system according to claim 1, wherein the shell layer has a lower glass transition temperature than the styrene acrylate polymer binder.

4. A toner for developing electrostatic images in a single component development (SCD) system according to claim 1, wherein the styrene acrylate polymer binder of the toner particles is a copolymer of styrene acrylate.

5. A toner for developing electrostatic images in a single component development (SCD) system according to claim 1, wherein the toner particles have an average particle size of from about 6 to about 8 μm, a circularity of about 0.95 to about 0.99, and a $GSD_{v\ and\ n}$ of about 1.15 to about 1.25.

6. A toner for developing electrostatic images in a single component development (SCD) system according to claim 1, wherein the toner has a triboelectric charging property of from about 10.0 to about 50.0 μC/g.

7. A toner for developing electrostatic images in a single component development (SCD) system according to claim 1, wherein the toner has a percent cohesion of from about 5% to about 30%.

8. A toner for developing electrostatic images in a single component development (SCD) system according to claim 1, wherein the toner particles have a melt flow index of from about 2.0 to about 70.0 g/10 minutes at a temperature of 130° C. under an applied load of 5.0 kilograms with an L/D die ratio of 3.8.

9. A toner for developing electrostatic images in a single component development (SCD) system according to claim 1, wherein the toner particles have a melt flow index of from about 5.0 to about 30.0 g/10 minutes at a temperature of 130° C. under an applied load of 5.0 kilograms with an L/D die ratio of 3.8.

10. A toner for developing electrostatic images in a single component development (SCD) system according to claim 1, wherein the toner particles include thereon one or more of external additive particles selected from the group consisting of a first silica having a size about 5 nm to about 15 nm that is coated with hexamethyldisilazane and/or a polydimethylsiloxane, a second silica having a size of about 20 nm to about 150 nm that is coated with hexamethyldisilazane and/or a polydimethylsiloxane, and titania having a size about 5 to about 130 nm.

11. A toner for developing electrostatic images in a single component development (SCD) system according to claim 10, wherein the first silica has a BET (Brunauer, Emmett and Teller) surface area of from about 100 to about 300 $m^2/g$, the second silica has a BET surface area of from about 20 to about 120 $m^2/g$, and the titania preferably has a BET surface area of from about 20 to about 120 $m^2/g$.

12. A toner for developing electrostatic images in a single component development (SCD) system according to claim 1, wherein the toner particles have a BET surface area of from about 0.5 to about 3.0 $m^2/g$.

13. A set of four toners for developing electrostatic images in a single component development (SCD) system comprising a, a cyan toner, a magenta toner, a yellow toner and a black toner, wherein each of the toners is a single component developer free of carrier and each of the cyan toner, magenta toner and yellow toners are comprised of emulsion aggregation toner particles comprising a styrene acrylate polymer binder, at least one release agent and at least one colorant, wherein each of the toner particles have a volume average particle size of from about 5 μm to about 10 μm, an average circularity of about 0.95 to about 0.99, a volume and number geometric standard deviation ($GSD_{v\ and\ n}$) of from about 1.10 to about 1.30, and an onset glass transition temperature of from about 45° C. to about 65° C., and wherein each of the toner particles further include a shell layer thereon comprising a styrene acrylate polymer, and wherein the styrene acrylate polymer of the shell layer and the styrene acrylate polymer binder are the same or are composed of a similar polymer with different chemical and physical characteristics.

14. A single component development (SCD) system including an image developing station, wherein a housing of the SCD system contains a single component developer for developing electrostatic images and including toner comprising emulsion aggregation toner particles comprising a styrene acrylate polymer binder, at least one release agent and at least one colorant, wherein the toner particles have a volume average particle size of from about 5 μm to about 10 μm, an average circularity of about 0.95 to about 0.99, a volume and number geometric standard deviation ($GSD_{v\ and\ n}$) of from about 1.10 to about 1.30, and an onset glass transition temperature of from about 45° C. to about 65° C., and the single component developer is provided from the housing to the image developing station, wherein the toner particles further include a shell layer thereon comprising a styrene acrylate polymer, and wherein the styrene acrylate polymer of the shell layer and the styrene acrylate polymer binder are the same or are composed of a similar polymer with different chemical and physical characteristics.

15. A method of forming an image with a single component developer, wherein the single component developer comprises toner particles free of carrier, comprising applying the toner particles having a triboelectric charge to an oppositely charged latent image on an imaging member to develop the image, and transferring the developed image to an image receiving substrate, and wherein the toner particles comprise emulsion aggregation toner particles comprising a styrene acrylate polymer binder, at least one release agent and at least one colorant, wherein the toner particles have a volume average particle size of from about 5 μm to about 10 μm, an average circularity of about 0.95 to about 0.99, a volume and number geometric standard deviation ($GSD_{v\ and\ n}$) of from about 1.10 to about 1.30, and an onset glass transition temperature of from about 45° C. to about 65° C., wherein the toner particles further include a shell layer thereon comprising a styrene acrylate polymer, and wherein the styrene acrylate polymer of the shell layer and the styrene acrylate polymer binder are the same or are composed of a similar polymer with different chemical and physical characteristics.

16. The method according to claim 15, wherein the triboelectric charge of the single component developer is from about 10.0 to about 50.0 μC/g.

17. The method according to claim 16, wherein the image is formed with a reduced speed single component development machine.

18. The method according to claim 15, wherein the triboelectric charge of the single component toner is from about 10.0 to about 40.0 μC/g.

19. The method according to claim 18, wherein the image is formed with a high speed single component development machine.

* * * * *